US007301506B2

(12) United States Patent
Kenkel et al.

(10) Patent No.: US 7,301,506 B2
(45) Date of Patent: Nov. 27, 2007

(54) SMALL BROADBAND HELICAL ANTENNA

(75) Inventors: Mark Allen Kenkel, Schaumburg, IL (US); Stuart P. Bauman, Skokie, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 37 days.

(21) Appl. No.: 11/345,168

(22) Filed: Feb. 1, 2006

(65) Prior Publication Data

US 2006/0176237 A1 Aug. 10, 2006

Related U.S. Application Data

(60) Provisional application No. 60/650,249, filed on Feb. 4, 2005.

(51) Int. Cl.
*H01Q 1/36* (2006.01)

(52) U.S. Cl. ..... 343/895; 343/700 MS

(58) Field of Classification Search ..... 343/895, 343/702, 700 MS
See application file for complete search history.

(56) References Cited

U.S. PATENT DOCUMENTS 4,442,438 A * 4/1984 Siwiak et al. ..... 343/792
5,977,931 A * 11/1999 Openlander ..... 343/895
7,245,268 B2 * 7/2007 O'Neill et al. ..... 343/895
2006/0022891 A1 * 2/2006 O'Neill et al. ..... 343/895

FOREIGN PATENT DOCUMENTS

JP 8-78945 * 3/1996

* cited by examiner

*Primary Examiner*—Hoang V. Nguyen
(74) *Attorney, Agent, or Firm*—Banner & Witcoff, Ltd.

(57) ABSTRACT

The invention provides methods and apparatuses for a helical antenna assembly that are constructed by placing a metallic tape strip diagonally onto non-metallic tape. The tape assembly is then rolled on a dielectric core. The metallic tape strip is coupled to an electrical connector and a center conductor that is located through the center of the dielectric core. The tape assembly may include one or two tabs that are bent over the ends the dielectric core to prevent the tape assembly from separating from the dielectric core. The tabs may be pinned by eyelets that are affixed to the center conductor. The pitch of the conductive portion of the tape assembly is determined to provide desired electrical characteristics when the tape assembly is wrapped around the dielectric core. The conductive portion of the tape assembly may be trimmed to obtain desired electrical characteristics.

12 Claims, 6 Drawing Sheets

FIG.4
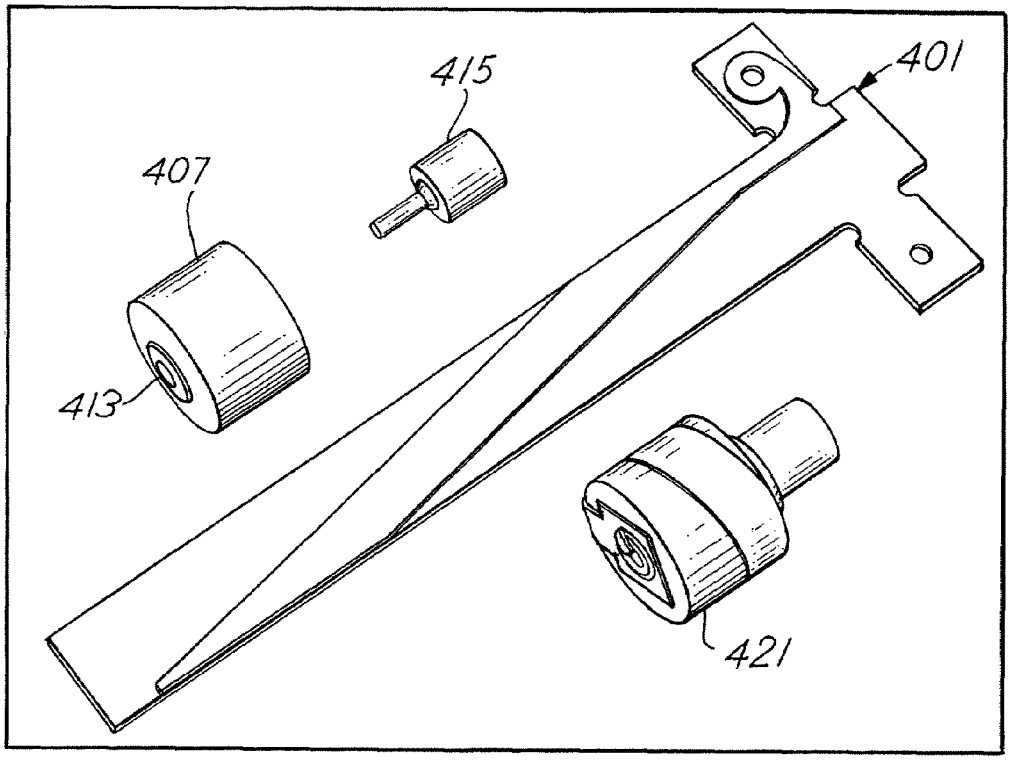
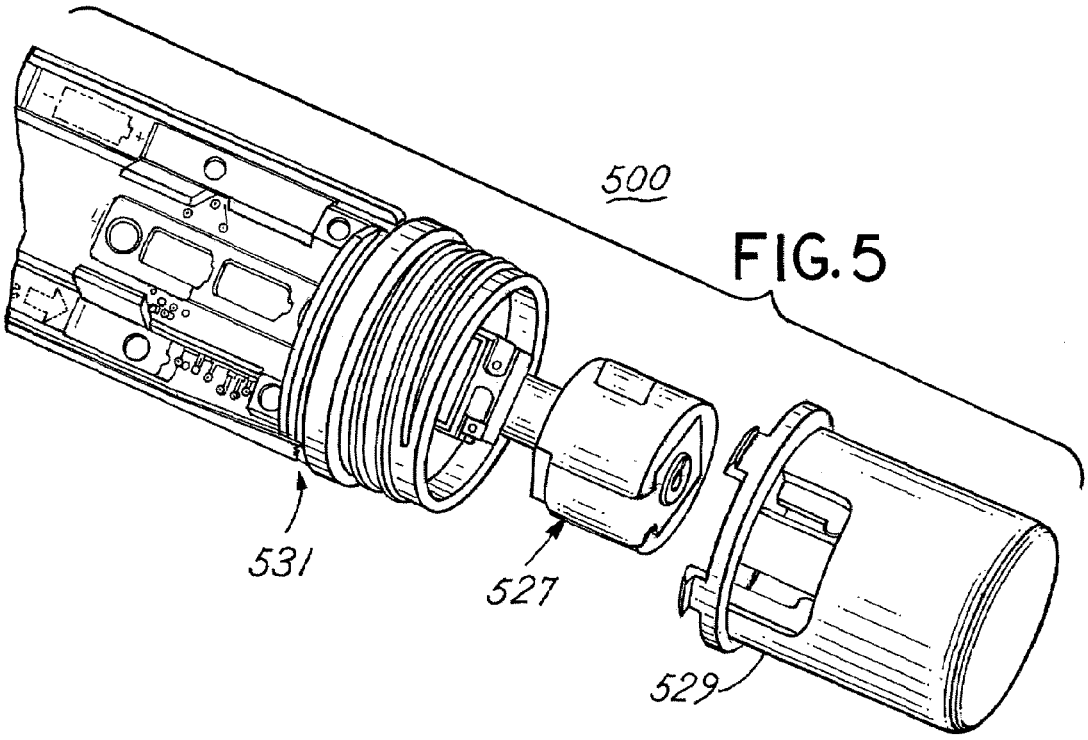
FIG.5

SMALL BROADBAND HELICAL ANTENNA

This application claims priority to provisional U.S. Application Ser. No. 60/650,249 ("Small Broadband Helical Antenna"), filed Feb. 4, 2005.

FIELD OF THE INVENTION

The invention relates to small broadband antennas, and more particularly helical antennas that may be used with wireless microphones.

BACKGROUND OF THE INVENTION

Wireless applications are becoming even more prevalent with the growing utilization of untethered computers, wireless telephones, and other wireless devices. However, in order to effectively support wireless applications, a RF signal is typically transmitted or received between wireless devices through a radio antenna. Radio antennas are typically bulky and incur a cost that may adversely increase the price of a wireless device. A "rubber ducky" antenna is an example of a radio antenna that is popularly used in wireless applications. A "rubber ducky" antenna is often constructed by wrapping wire around a core insulator and covered by protective material. Consequently, a "rubber ducky" antenna is often bulky, obstructive, and costly. Moreover, the electrical characteristics of a "rubber ducky" antenna may be insufficient. For example, the operating frequency bandwidth tends to be narrow, while many wireless applications may require broadband operation. Additionally signal loss due to the proximity of a user's hand may be excessive.

The approaches of the prior art, as described heretofore, provide antenna assemblies having construction attributes, electrical characteristics and associated costs that are often lacking for wireless applications. Thus, there is a real need in the market place to provide a radio antenna, e.g., a helical antenna, that is low cost, small, easy to assemble, and broadband with low sensitivity to hand proximity.

BRIEF SUMMARY OF THE INVENTION

Aspects of the invention provide solutions to at least one of the issues mentioned above, thereby enabling one to construct a radio antenna with conductive material that is affixed on tape. The tape is secured to a base material.

With one aspect of the invention, a helical antenna assembly is constructed by placing a metallic tape strip diagonally onto a rectangular piece of non-metallic tape. The tape assembly is then rolled on a dielectric core. The metallic tape strip is then coupled to an electrical connector.

With another aspect of the invention, a center conductor is inserted through the center of the dielectric core. The center conductor is electrically coupled to an electrical connector. The tape assembly includes one or two tabs that bend over the ends the dielectric core to prevent the tape assembly from separating from the dielectric core. The tabs may be further pinned by eyelets.

With another aspect of the invention, the pitch of the conductive portion of the tape assembly is determined to provide desired electrical characteristics when the tape assembly is wrapped around the dielectric core.

With another aspect of the invention, the conductive portion of the tape assembly is trimmed in length to obtain desired electrical characteristics, including the center operating frequency. Parasitic effects of surrounding components may be compensated when tuning the antenna assembly.

With another aspect of the invention, a helical antenna is formed by determining a length of a conductive portion to obtain desired characteristics of the helical antenna, laminating the conductive portion to a base portion to form a tape assembly in which the conductive portion is diagonally placed on the base portion, wrapping the tape assembly around a dielectric core, and electrically coupling an electrical connector to the conductive portion.

With another aspect of the invention, a helical antenna assembly includes a dielectric core, a tape assembly that is wrapped around the dielectric core where the tape assembly further includes a base portion and a conductive portion, and an electrical connector that is coupled to the conductive portion of the tape assembly. The conductive portion is diagonally placed on the base portion with a determined pitch and has a length and a width in order to obtain desired electrical characteristics.

With another aspect of the invention, a double-helical antenna assembly includes a dielectric core, a tape assembly that is wrapped around the dielectric core where the tape assembly further includes a base portion and a conductive portion, and an electrical connector that is coupled to a center feed-point of the conductive portion. The conductive portion includes two diagonal conductive sections that join at the center feed-point with a determined pitch. Each diagonal conductive portion has a length and a width to obtain desired electrical characteristics.

BRIEF DESCRIPTION OF THE DRAWINGS

FIG. 4 shows components of a helical antenna assembly and a resulting assembled antenna assembly in accordance with an embodiment of the invention;

FIG. 5 shows a microphone assembly that includes a helical antenna assembly in accordance with an embodiment of the invention;

DETAILED DESCRIPTION OF THE INVENTION

Figure 1A:
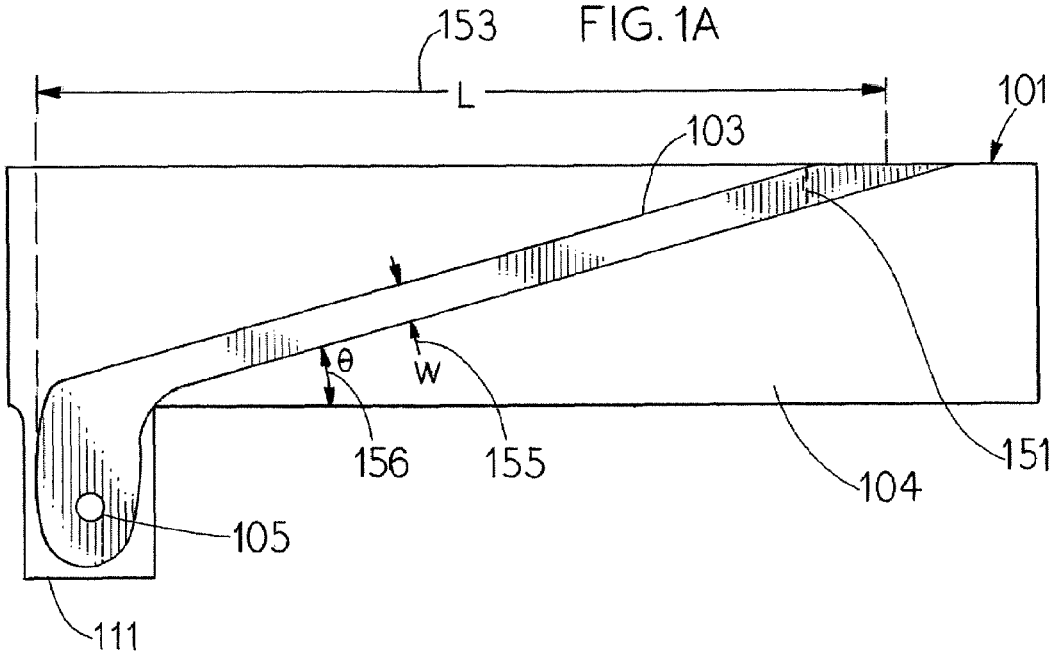
FIGS. 1A-1C show components of a broadband helical antenna in accordance with an embodiment of the invention.
Figure 1B:
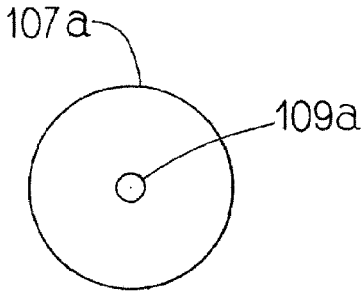
Figure 1C:
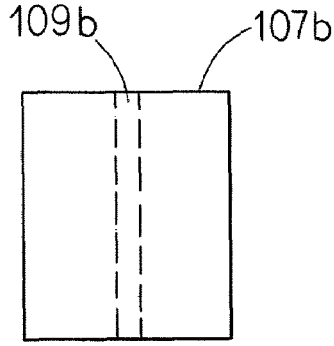

FIG. 1 shows components of a broadband helical antenna in accordance with an embodiment of the invention. Tape assembly 101 comprises base portion 104 and conductive portion 103 (which comprises copper tape in the embodiment shown). In the embodiment, base portion 104 is constructed from a vinyl core material that is laminated with copper tape 103 with electro tin plating. (In the embodiment shown, 3M™ number 9471 adhesive with an approximate thickness of 2.0 mils is used for laminating the copper tape 103 with base portion 104. Copper tape 103 may be electroplated on base portion 104 and laser trimmed or mechanically trimmed to provide the desired width and length dimensions. Also, as will be discussed, copper tape 103 may be subsequently cut at line 151, in which the excessive length of copper tape is removed, in order to adjust and tune the helical antenna assembly. The frequency characteristics are determined by a number of parameters that include length (L) 153, width (W) 155, and pitch (θ) 156 of copper tape 103. In the exemplary embodiment shown in FIG. 1, tape assembly 101 is approximately 10 cm long and 14 mm wide with conductive portion 103 having width 155 of approximately 7 mm and corresponding to a frequency operating range of 578-650 MHz.

As shown in FIG. 1, tape assembly 101 includes tab 111 on which copper tape 103 is extended to be electrically coupled to other components of the antenna assembly as will be discussed. Copper tape 103 forms hole 105 on tab 111 to support the electrical coupling.

Figure 2A:
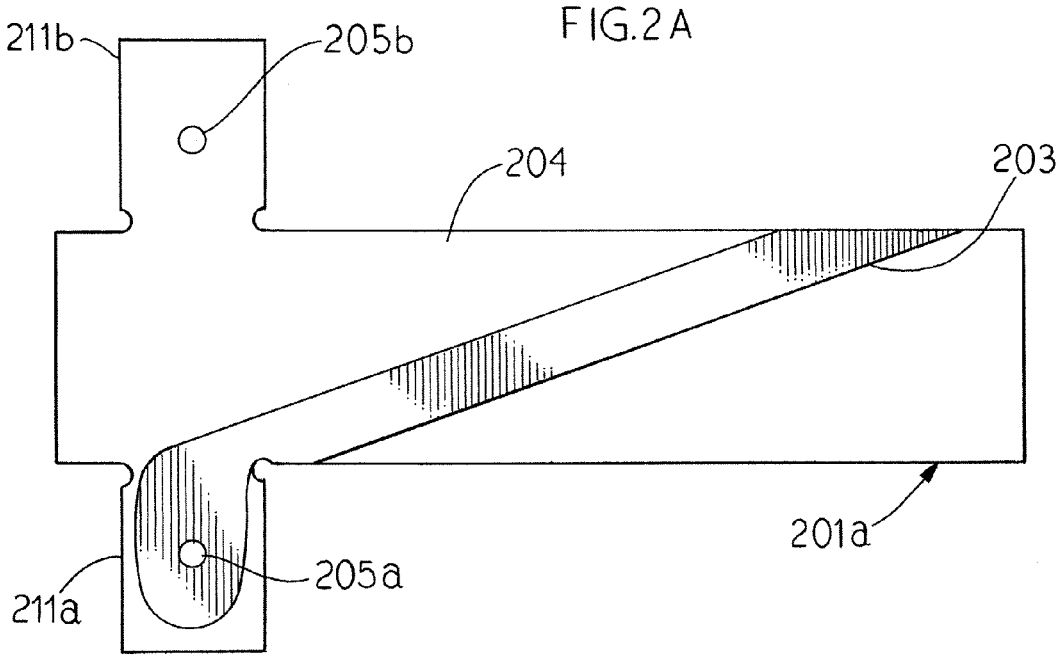
FIGS. 2A and 2B show a tape assembly and illustrates a procedure for wrapping the tape assembly around dielectric material to form an antenna assembly in accordance with an embodiment of the invention.
Figure 2B:
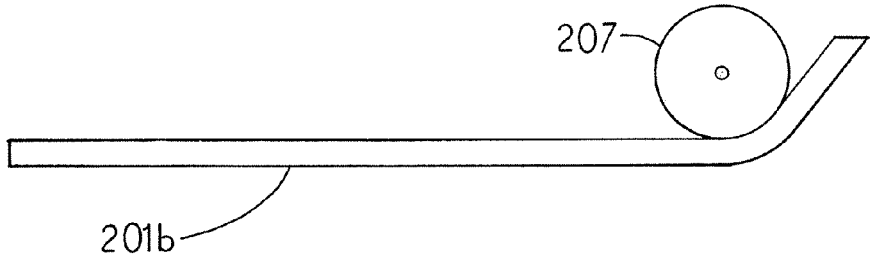

Tape assembly 101 comprises tab 111, although other embodiments of the invention may support more than one tab (e.g., tabs 211*a* and 211*b* as shown in FIG. 2.)

As will be discussed, tape assembly 101 is wrapped around dielectric core 107 (corresponding to top view 107*a* and side view 107*b*). Center conductor 109 (corresponding to top view 109*a* and side view 109*b*) is located at essentially the center of dielectric core 107 and extends through the entire length of dielectric core 107. The length of center conductor 109 is typically longer than the length of dielectric core 107 so that the ends of center conductor 109 extend beyond dielectric core 107 for mechanical and electrical coupling. As will be discussed, an eyelet flange and a SMA connector may be attached to the ends of center conductor 109. In the embodiment, the length of dielectric core 107 is approximately 14 mm (to match the width of tape assembly 101) and the diameter of dielectric core 107 is approximately 0.680 to 0.684 inches.

In an embodiment of the invention, dielectric core 107 is formed from Texin® 285 urethane thermoplastic elastomer (manufactured by Bayer MaterialScience). Texin® 285 possesses fairly constant consistent dielectric properties with a dielectric constant between 5.6 and 6.5 and a good electrical strength of approximately 445 Kv/in.

FIG. 2 shows tape assembly 201 and illustrates a procedure for wrapping tape assembly 201 around dielectric material 207 to form an antenna assembly in accordance with an embodiment of the invention. Tape assembly 201 (corresponding to top view 201*a* and side view 201*b*) comprises conductive portion 203 and base portion 204.

Figure 3A:
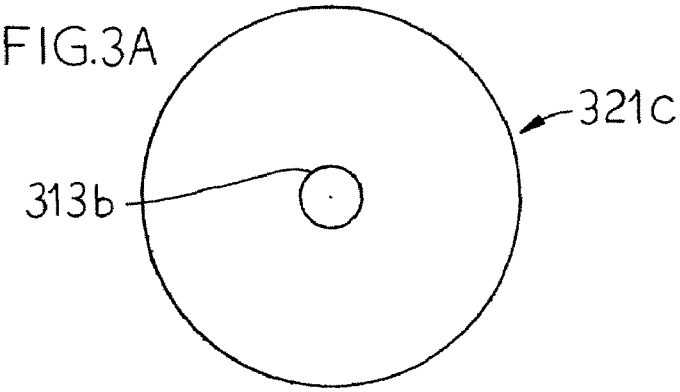
FIGS. 3A-3C show a helical antenna assembly in accordance with an embodiment of the invention.
Figure 3B:
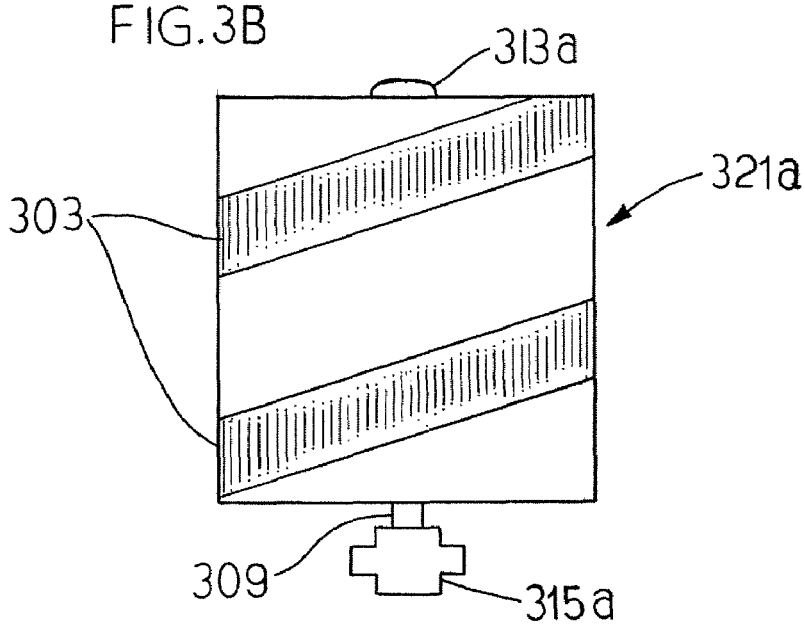
Figure 3C:
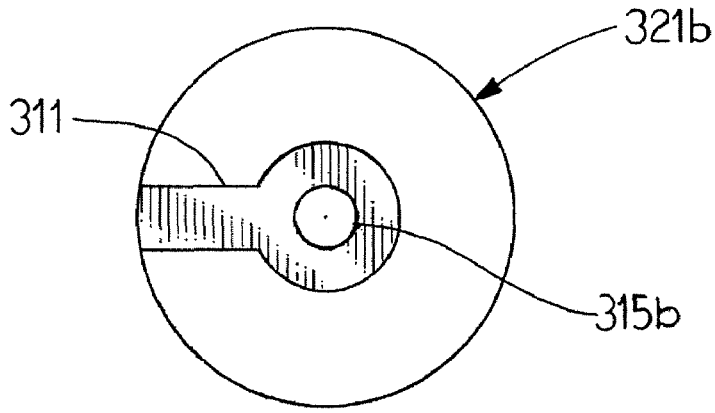

Tape assembly 201 includes tabs 211*a* and 211*b* which form holes 205*a* and 205*b*, respectively. Hole 205*a* is formed through conductive portion 203, an electrical connector may be electrically coupled to conductive portion 203 near hole 205*a* by soldering an electrical connector (e.g., SMA connector 315 as shown in FIG. 3) to a center conductor (not shown) which protrudes through hole 205*a*. An eyelet flange (not shown) may be fastened to the other end of the center conductor through hole 205*b*.

Tape assembly 201 (shown as side view 201*b*) is wrapped around dielectric core 207. (An adhesive may be applied to tape assembly 201 to prevent tape assembly 201 from detaching from dielectric core 207.) In the embodiment, dielectric core 207 is wrapped from right to left in order to show indicia (not shown) that may be on tape assembly 201. The indicia may be used for identification purposes of the antenna assembly. However, tape assembly 201 may be wrapped from left to right without significantly altering the electrical characteristics of the antenna assembly.

After tape assembly 201 is wrapped around dielectric core 207, tabs 211*a* and 211*b* are bent to be flush with the ends of dielectric core 207. In the exemplary embodiment shown in FIG. 2, notches are formed between each tab 211*a* and 211*b* and the main portion of tape assembly 201 to facilitate the bending of tabs 211*a* and 211*b*.

In the embodiment, the pitch of conductive portion 203 is selected so that conductive portion 203 does not overlap when tape assembly 201 is wrapped around dielectric core 207.

FIG. 3 shows helical antenna assembly 321 (corresponding to side view 321*a*, bottom view 321*b*, and top view 321*c*) in accordance with an embodiment of the invention. Side view 321*a* illustrates conductive portion 303 wrapped around dielectric core (not labeled). Center conductor 309 goes through the center of the dielectric core. The core pin of SMA connector 315 (corresponding to side view 315*a* and bottom view 315*b*) is soldered to conductive extension 311 (which is an extension of conductive portion 303) and center conductor 309. A ground for helical antenna assembly 321 is established by the conductivity properties of the microphone enclosure. Flange 313 (corresponding to top view 313*b* and side view 313*a*) is fastened to the other end (opposite of SMA connector 315) of center conductor 309. Flange 313 may be machined as part of center conductor 309 or may be formed by fastening an eyelet on center conductor 309. Also, an eyelet may be fastened on the connector end to maintain the positioning of conductive extension 311 before assembling SMA conductor 315.

Antenna assembly 321 utilizes one tab (corresponding to conductive extension 311). However, other embodiments of the invention may use more than one tab (e.g., tabs 211*a* and 211*b* as shown in FIG. 2. Using two tabs helps to prevent the copper tape from un-rolling in high humidity and moister environments. In the associated embodiments, the tabs are bent across the top and bottom of the dielectric core and pinned with the eyelet that is used to connect the antenna to the RF connector. A tab may be lengthened to ensure that the metal end of the tape assembly is covered after being wrapped.

FIG. 4 shows components of a helical antenna assembly and a resulting assembled antenna assembly 421 in accordance with an embodiment of the invention. Antenna assembly 421 includes tape assembly 401, dielectric core 407, and SMA connector 415. FIG. 4 illustrates the position of eyelet 413 in relation to dielectric core 407. As with the embodiments shown in FIGS. 2 and 3, dielectric core 407 has a hole drilled through the center to accommodate a center conductor (not visible).

FIG. 5 shows microphone assembly 500 that includes helical antenna assembly 527 in accordance with an embodiment of the invention. (Microphone assembly 500 includes acoustical transducers (not shown) and a microphone cover (not shown) located at the left side of FIG. 5.) Helical antenna assembly 527 connects to electronic circuitry that converts an audio signal into an electrical signal that is transmitted through helical antenna assembly 527. Helical antenna assembly 527 is positioned by housing 531 and covered by antenna cover 529.

In the embodiment shown in FIG. 5, antenna cover 529 comprises Santoprene® 103-50 thermoplastic rubber that is manufactured by Advanced Elastomer Systems. Santoprene® 103-50 exhibits a dielectric constant of approximately 2.3 with a dielectric strength of approximately 498 Kv/inch.

Figure 6:
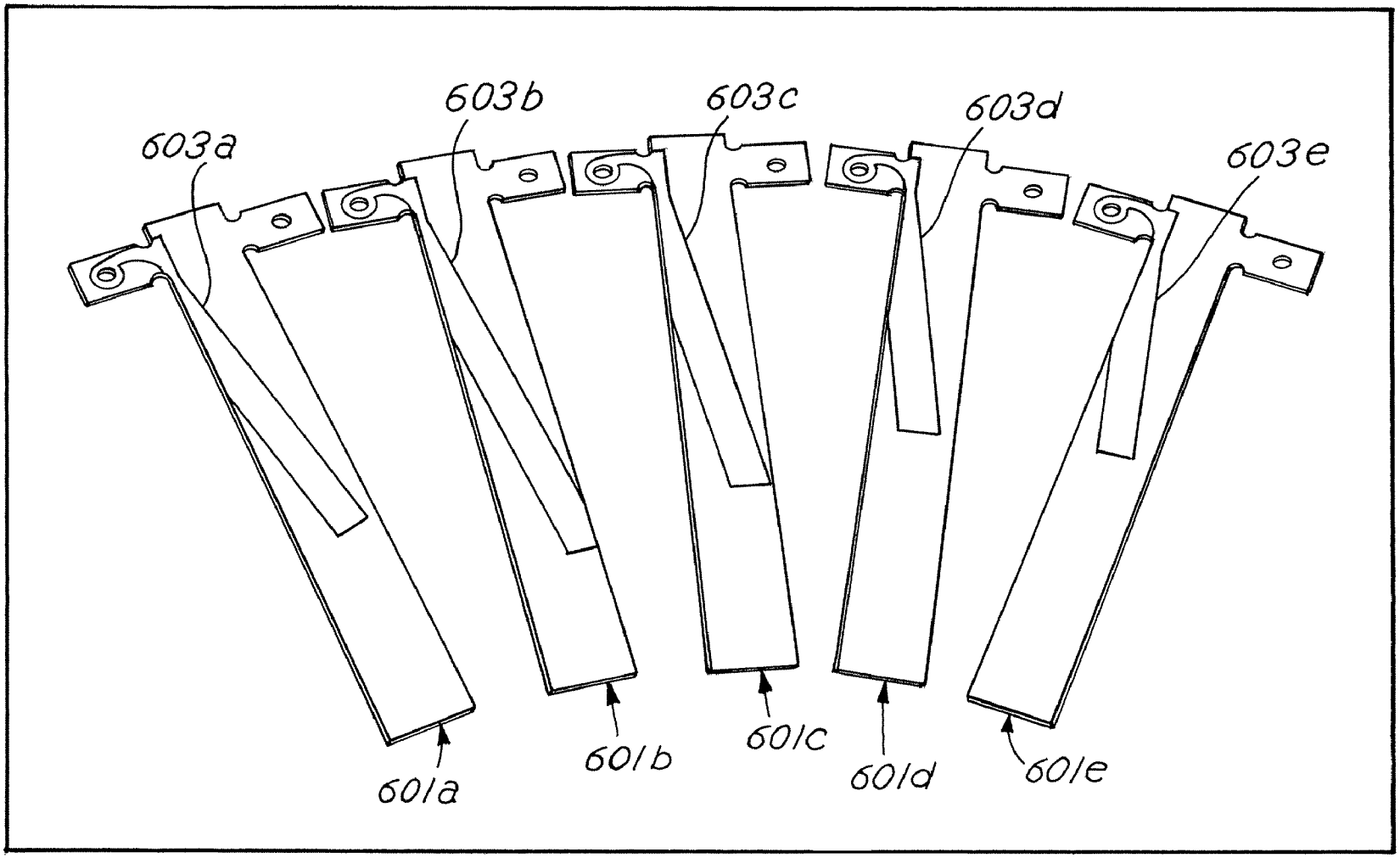
FIG. 6 shows tape assemblies for different frequency operating ranges in accordance with an embodiment of the invention.

FIG. 6 shows tape assemblies for different frequency operating ranges in accordance with an embodiment of the invention. Tape assemblies 601*a*, 601*b*, 601*c*, 601*d*, and 601*e* correspond to frequency ranges of 518-578 MHz, 578-638 MHz, 638-689 MHz, 740-814 MHz, and 798-862 MHz, respectively. Conductive portions 603*a*-603*e* are trimmed to obtain the desired electrical characteristics when exposed to anticipated parasitic effects. In order to identify characteristics of an antenna assembly, indicia may be laser cut, stamped, or printed on the tape assembly. When the tape assembly is rolled on the dielectric core, the indicia are visible to provide easy identification during and after the construction of the antenna assembly.

Each tape assembly 601*a*-601*e* uses the same pitch. However, the length of the conductive portions is adjusted to provide the desired electrical characteristics. An approximate length is determined without the parasitic effects of the antenna cover and microphone case. For example, the shape and material of the antenna cover and microphone case will affect the electrical characteristics. However, the parasitic effects are not typically large and may be compensated by trimming the conductive portion (e.g., the laminated copper tape) of the tape assembly.

FIGS. 1-6 illustrate exemplary embodiments of the invention that support a wireless microphone (which functionally operates as a handheld transmitter). However, embodiments of the invention may support other wireless applications in which radio frequency signals are generated. Experimental data suggests that the embodiments shown in FIGS. 1-6 are low cost, small, and easy to assemble.

An antenna assembly (e.g., antenna assembly 527) has broadband frequency characteristics with a bandwidth greater than 10% with center frequencies greater than 500 MHz. The embodiments exhibit low sensitivity to hand placement or hand proximity.

The embodiments shown in FIGS. 1-6 enable one to easily adjust the center frequency of operation. For example, the length of conductive portion 103 (which comprises copper tape) may be shortened by cutting conductive portion 103 along line 151 as shown in FIG. 1. The antenna assembly is typically tuned to compensate for parasitic effects (e.g., the effects of antenna case 529 as shown in FIG. 5) by tuning conductive portion 103. Moreover, the embodiments that are shown in FIGS. 1-6 exhibit repeatable results.

The embodiment shown in FIGS. 1-6 have exhibited VSWR values of 1.2:1 within the operating frequency range whether the microphone is positioned in a stand or held by a user. The embodiments typically exhibit VSWR values of less than 3:1 for the entire frequency range.

In the embodiments shown in FIGS. 1-6, the pitch of the conductive portion (e.g., conductive portions 603*a*-603*d* as shown in FIG. 6) is essentially the same. In order to obtain the desired frequency range, the conductive portion is trimmed to the necessary length. However, other embodiments of the invention may tune the frequency characteristics by adjusting other parameters, e.g., the dielectric constant of the dielectric core or the width of the conductive portion. Moreover, the wider the conductive portion, the lower the Q of the antenna assembly, thus resulting in a wider frequency bandwidth of operation. (However, increasing the width of the conductive portion reduces the maximum length of the conductive portion for a given diameter of the dielectric core in order to avoid overlapping the conductive portion.)

While the embodiments shown in FIGS. 1-6 illustrate exemplary embodiments of wireless microphones, other embodiments of the invention may support other wireless applications that require a wireless device for either receiving or transmitting a RF signal.

Figure 7A:
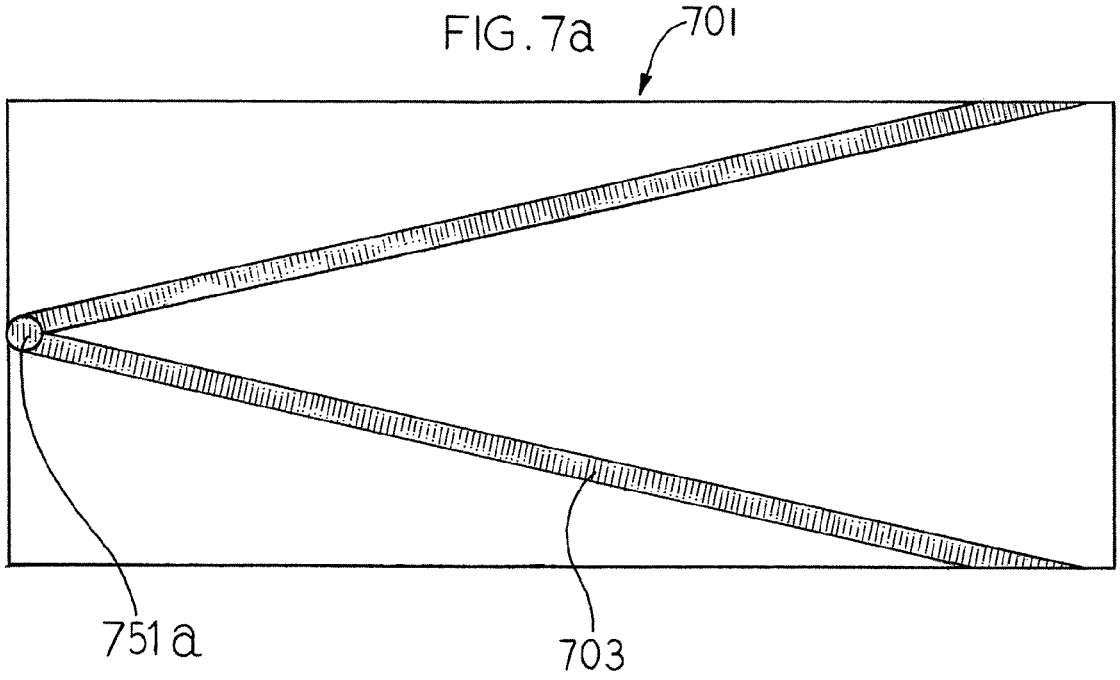
FIGS. 7A and 7B show a double helical antenna assembly in accordance with an embodiment of the invention.
Figure 7B:
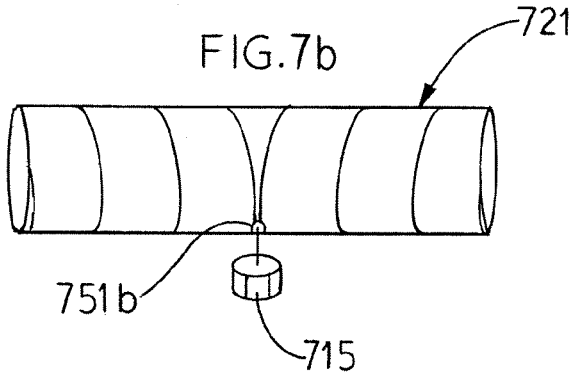

While the embodiments shown in FIGS. 1-6 illustrate exemplary embodiments of a helical antenna, other embodiments of the invention support other types of antennas. FIG. 7 shows a double-helical (ram's horn) antenna assembly in accordance with an embodiment of the invention. Tape assembly 701 comprises copper tape 703 forming a "vee" shape with a center feed-point 751*a*. Tape assembly 701 is wrapped around a dielectric core to form antenna assembly 721. RF energy is provided to antenna assembly 721 through SMA connector 715, which is soldered to center feed-point 751*b*.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

We claim:

1. A method for forming a helical antenna, comprising:

(A) determining a length of a conductive portion to obtain desired electrical characteristics of the helical antenna;

(B) laminating the conductive portion to a base portion to form a tape assembly, wherein the conductive portion is diagonally placed on the base portion;

(C) wrapping the tape assembly around a dielectric core;

(D) electrically coupling an electrical connector to the conductive portion;

(E) inserting a center conductor through the approximate center of the dielectric core; and (F) bending at least one tab of the tape assembly over at least one end of the dielectric core.

2. The method of claim 1, further comprising:

(G) pinning the at least one tab with an eyelet.

3. The method of claim 1, further comprising:

(G) trimming the conductive portion of the tape assembly to compensate for parasitic effects of surrounding components.

4. A helical antenna assembly comprising:

a dielectric core;

a tape assembly that is wrapped around the dielectric core, the tape assembly comprising:

a base portion;

a conductive portion that is diagonally placed on the base portion with a determined pitch and that has a length and a width to obtain desired electrical characteristics; and at least one tab, and wherein the at least one tab is bent over at least one end of the dielectric core;

an electrical connector that is coupled to the conductive portion of the tape assembly;

a center conductor that is positioned through a center of the dielectric core and that is electrically coupled to the conductive portion of tape assembly and the electrical connector; and an eyelet that is affixed to the center conductor at an electrically coupled end of the dielectric core.

5. A helical antenna assembly comprising:

a dielectric core;

a tape assembly that is wrapped around the dielectric core, the tape assembly comprising:

a base portion;

a conductive portion that is diagonally placed on the base portion with a determined pitch and that has a length and a width to obtain desired electrical characteristics;

two tabs, wherein each tab is bent over a corresponding end of the dielectric core; and two eyelets that are affixed to a center conductor at each end of the dielectric core, wherein each eyelet pins one of the two tabs;

an electrical connector that is coupled to the conductive portion of the tape assembly; and the center conductor that is positioned through a center of the dielectric core and that is electrically coupled to the conductive portion of tape assembly and the electrical connector.

6. A method for forming a helical antenna, comprising:

(A) determining a length of a conductive portion to obtain desired electrical characteristics of the helical antenna;

(B) laminating the conductive portion to a base portion to form a tape assembly, wherein the conductive portion is diagonally placed on the base portion to provide a desired pitch;

(C) wrapping the tape assembly around a dielectric core, tape edges of the tape assembly being parallel to end edges of the dielectric core, wherein a width of the tape assembly is approximately equal to a length of the dielectric core; and (D) electrically coupling an electrical connector to the conductive portion.

7. The method of claim 6, further comprising:

(E) trimming the conductive portion of the tape assembly to compensate for parasitic effects of surrounding components.

8. The method of claim 6, further comprising:

(E) inserting a center conductor through the approximate center of the dielectric core.

9. A helical antenna assembly comprising:

a dielectric core;

a tape assembly that is wrapped around the dielectric core, tape edges of the tape assembly being parallel to end edges of the dielectric core, wherein a width of the tape assembly is approximately equal to a length of the dielectric core, the tape assembly comprising:

a base portion; and a conductive portion that is diagonally placed on the base portion with a determined pitch and that has a length and a width to obtain desired electrical characteristics; and an electrical connector that is coupled to the conductive portion of the tape assembly.

10. The helical antenna assembly of claim 9, further comprising:

a center conductor that is positioned through a center of the dielectric core and that is electrically coupled to the conductive portion of tape assembly and the electrical connector.

11. The helical antenna assembly of claim 10, further comprising:

an eyelet that is affixed to the center conductor at an electrically coupled end of the dielectric core.

12. A double-helical antenna assembly comprising:

a dielectric core;

a tape assembly that is wrapped around the dielectric core, tape edges of the tape assembly being parallel to end edges of the dielectric core, wherein a width of the tape assembly is approximately equal to a length of the dielectric core, the tape assembly comprising:

a base portion; and a conductive portion that is placed on the base portion, that includes two diagonal conductive sections that join at a center feed-point with a determined pitch, and that is diagonally placed on the base portion with a determined pitch, wherein each diagonal conductive section has a length and a width to obtain desired electrical characteristics; and an electrical connector that is coupled to the center feed-point of the conductive portion.

* * * * *